US008984927B2

(12) United States Patent
Nanba et al.

(10) Patent No.: US 8,984,927 B2
(45) Date of Patent: Mar. 24, 2015

(54) DIE FOR MACHINE PRESS

(75) Inventors: Tsuyoshi Nanba, Toyota (JP); Hiroshi Imakawa, Anjo (JP); Isao Nojiri, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/583,748

(22) PCT Filed: Dec. 22, 2010

(86) PCT No.: PCT/JP2010/073209

§ 371 (c)(1),
(2), (4) Date: Sep. 10, 2012

(87) PCT Pub. No.: WO2012/086038

PCT Pub. Date: Jun. 28, 2012

(65) Prior Publication Data

US 2013/0255351 A1 Oct. 3, 2013

(51) Int. Cl.

| | |
|---|---|
| ***B21D 37/12*** | (2006.01) |
| ***B30B 15/02*** | (2006.01) |
| ***B21D 37/10*** | (2006.01) |

(Continued)

(52) U.S. Cl.

CPC ..... *B30B 15/02* (2013.01); *B21D 37/10* (2013.01); *B21D 28/32* (2013.01); *B21D 37/02* (2013.01)

USPC ..... 72/455; 72/450; 72/465.1; 72/466.8

(58) Field of Classification Search

CPC ..... B21D 22/02; B21D 37/08; B21D 37/10; B21D 37/12; B21J 9/02; B21J 13/02; B21J 13/04

USPC ..... 72/352, 446, 448, 450, 451, 453.01, 72/455, 456, 465.1, 466.8; 100/214, 281, 100/286

See application file for complete search history.

(56) References Cited

U.S. PATENT DOCUMENTS

| | | | | | |
|---|---|---|---|---|---|
| 934,701 | A | * | 9/1909 | Swanson | 72/429 |
| 1,842,073 | A | * | 1/1932 | Davis | 38/36 |
| 2,133,477 | A | * | 10/1938 | Schade | 72/412 |

(Continued)

FOREIGN PATENT DOCUMENTS

| | | |
|---|---|---|
| CN | 101060945 A | 10/2007 |
| JP | A-56-019935 | 2/1981 |

(Continued)

OTHER PUBLICATIONS

Written Opinion of the International Searching Authority issued in Application No. PCT/JP2010/073209; Dated Jan. 25, 2011 (With Translation).

(Continued)

*Primary Examiner* — Edward Tolan
(74) *Attorney, Agent, or Firm* — Oliff PLC

(57) ABSTRACT

A die having adequate flexibility at an entirety thereof while maintaining rigidity of a design surface is presented. A die is a die for a machine press. The die is a die for pressing a work plate together with a contraposed die and forming the work plate into a target shape. The die is provided with a design block, a positioning block, and a plurality of rods. The design block has a design surface for transferring the target shape to the work plate. The positioning block is used for positioning the die relative to the contraposed die. The design block and the positioning block are connected by the plurality of rods.

8 Claims, 3 Drawing Sheets

(51) Int. Cl.

| | |
|---|---|
| ***B21D 28/32*** | (2006.01) |
| ***B21D 37/02*** | (2006.01) |

(56) References Cited

U.S. PATENT DOCUMENTS

| | | | | | |
|---|---|---|---|---|---|
| 2,235,553 | A | * | 3/1941 | Haversack | 72/400 |
| 2,483,597 | A | * | 10/1949 | Schogren | 72/445 |
| 3,418,922 | A | * | 12/1968 | Kip, Jr. | 100/214 |
| 3,418,923 | A | * | 12/1968 | Zeitlin et al. | 100/214 |
| 4,175,417 | A | * | 11/1979 | Vergnani et al. | 72/356 |
| 4,406,151 | A | * | 9/1983 | Simonsen et al. | 72/478 |
| 4,494,397 | A | * | 1/1985 | Rhoades | 72/320 |
| 4,615,204 | A | * | 10/1986 | Yamamoto et al. | 72/347 |
| 4,643,017 | A | * | 2/1987 | Nelson | 72/446 |
| 4,706,490 | A | * | 11/1987 | Zeitlin et al. | 72/455 |
| 4,805,440 | A | * | 2/1989 | Lenders | 72/455 |
| 4,878,374 | A | * | 11/1989 | Nelson | 72/446 |
| 5,097,734 | A | * | 3/1992 | Hunter et al. | 83/639.1 |
| 5,343,728 | A | * | 9/1994 | Chubb et al. | 72/319 |
| 5,623,849 | A | * | 4/1997 | Goff et al. | 72/394 |
| 7,063,010 | B2 | * | 6/2006 | Zhang | 100/231 |
| 7,448,247 | B2 | * | 11/2008 | Knaup | 72/350 |
| 2008/0098789 | A1 | | 5/2008 | Hori et al. | |

FOREIGN PATENT DOCUMENTS

| | | | | |
|---|---|---|---|---|
| JP | U-04-043424 | | 4/1992 | |
| JP | A-06-210351 | | 8/1994 | |
| JP | A-07-323400 | | 12/1995 | |
| JP | A-2011-240351 | | 12/2011 | |
| JP | A-2011-245534 | | 12/2011 | |
| WO | 2006/057196 | A1 * | 6/2006 | B21D 22/02 |

OTHER PUBLICATIONS

International Search Report issued in Application No. PCT/JP2010/073209; Dated Feb. 8, 2011 (With Translation).

* cited by examiner

DIE FOR MACHINE PRESS

TECHNICAL FIELD

The present invention relates to a die for a machine press.

BACKGROUND ART

Many improvements for dies for a machine press have been proposed. For example, a die in which a plurality of links is connected in a mesh shape is proposed in Patent Document 1. In this die, a mesh surface forms a design surface. In this die, the shape of the mesh, i.e., the design surface, can be changed in various ways by changing the connecting angle of the links. Here, in the present specification, "design surface" means a surface that makes contact with a work plate, is formed in a target shape, and transfers this target shape to the work plate. Below, in order to simplify the description, the "die for a machine press" is simply called the "die".

CITATION LIST

Patent Literature

Patent Document 1: Japanese Patent Application Publication No. H6-210351 (1994-210351)

SUMMARY OF THE INVENTION

Technical Problem

In general, a die is utilized as a part of a pair. One of the dies is attached to a bolster of a press machine, and the other of the dies is attached to a slider. After a work plate has been positioned between the pair of dies, the slider descends, a load is applied to the work plate, and the dies are pressed against the work plate. The work plate deforms along the design surface of the die, transferring the target shape to the work plate.

When press processing is performed, a high load is applied to the die. Consequently, the die requires high rigidity. On the other hand, when work is to be formed by a pair of dies, the positioning of the pair of dies is also important. For positioning, each of the pair of dies usually has a guide pin and a guide bush. At the time of pressing, as one die approaches the other die, the guide pin provided on the one die fits with the guide bush provided on the other die, thus allowing the two to be positioned accurately. That is, the die has a part having the design surface and a part for positioning. When the pair of dies has been positioned accurately by using the guide pin and the guide bush, the position of the design surface of both of the pair of dies is also strictly determined. Here, since the rigidity of the die is high and the position of the design surface is firmly fixed, the load may be concentrated on a particular part of the design surface. Concentration of the load may cause local damage to the design surface. Alternatively, the entire die may be inclined by the concentration of the load, thus the processing accuracy of the work may be reduced. On the other hand, if the rigidity of the die is low, the design surface itself may deform, thus processing accuracy may be reduced. For example, since the technique of Patent Document 1 utilizes the mesh-shaped links as the design surface, high rigidity cannot be expected in the design surface, and the technique is not suitable for pressing a comparatively hard work plate. The present specification presents a technique which gives adequate flexibility to the entire die while maintaining the rigidity of the design surface.

Solution to the Technical Problem

In one aspect of a novel die taught in the present specification, the die comprises a framework, a design block, and a positioning block. The framework is assembled from a plurality of rods. The framework is assembled from the plurality of rods so as to have a Rahmen structure, a truss structure, or a combination of the Rahmen and the truss structures. The Rahmen structure and the truss structure are technical terms used in the field of structural mechanics or architecture. A "truss structure" means a structure that is assembled from rods, and is a structure in which only force in an axial direction is applied to the rods, and bending moment is not applied thereto. A "Rahmen structure" means a structure that is assembled from rods, and is a structure in which both force in the axial direction and the bending moment are applied to the rods.

Any of the rods, the design block, and the positioning block may typically be made from steel, cast iron, or another metal.

The design block is a block having a design surface for transferring a target shape to a work plate. The positioning block is a block for positioning the die relative to a counterpart die attached to a press machine, and typically is a block having a guide pin or a block having a guide bush. It should be noted that the component used for positioning is not limited to a pin or a bush.

Both the design block and the positioning block are fixed to the framework. However, the design block and the positioning block are fixed to the framework at positions separate from one another. In other words, this die has a shape in which the design block and the positioning block are connected by the plurality of rods, and the plurality of rods is assembled into the truss structure, the Rahmen structure, or the framework structure in which the truss and the Rahmen structures are combined. Below, to simplify the description, a "structure configured of a plurality of rods and having the truss structure, the Rahmen structure, or the structure in which the truss and the Rahmen structures are combined" is simply called a "framework structure". That is, the aforementioned die comprises the framework having the framework structure.

Since the design surface is provided on the design block, the design surface has high rigidity. The guide pin or the guide bush is provided on the positioning block, and the rigidity of the positioning block itself is high. On the other hand, since the design block and the positioning block are connected by the rods, the design block has adequate flexibility relative to the positioning block. In particular, in the framework in which the rods are assembled in the framework structure, the rigidity of each part is easily predicted, and consequently the desired rigidity is easily achieved. This is a major factor in achieving appropriate rigidity between the positioning block and the design block. Describing this die from another perspective, the framework has a rigidity that is lower than the rigidity of the positioning block, and that is lower than the rigidity of the design block.

In another aspect of the die taught in the present specification, it is preferred that the design block is surrounded by the plurality of rods in a plan view of the die, and that the positioning block is disposed at a periphery of the die (at a periphery of the framework). Here, a "plan view of the die" is equivalent to "viewed from the front of the design surface". It is preferable for the positioning block to be disposed at the periphery of the die so as to accurately determine the position of the design block located near the center of the framework.

Further, the design block is disposed opposite to the design surface of the contraposed die (counterpart die), with the work plate sandwiched therebetween, and the design block receives the load. It is preferred that, upon receiving the load, the design surface of the design block and the design surface of the counterpart die become parallel. For this purpose, four sides of the design block may respectively be supported uniformly by the rods.

In another preferred aspect of the die taught in the present specification, is the framework has a vertical rod that supports a backside of the die. This is because supporting the backside of the die is preferred so as to withstand the load when pressing.

Not only the design block, but also a block for supporting a tool for machining the work plate may be fixed to the framework. Various tools utilizing the pressing load may be attached to the die for a machine press. For example, there is a tool that converts the pressing load in a direction perpendicular to the pressing direction and creates a hole in the work plate. Alternatively, there is a tool that converts the pressing load in the direction perpendicular to the pressing direction and bends the work plate. It is preferred that, like the design block, this type of block for supporting the tool also has high rigidity and relative flexibility with respect to the positioning block. Consequently, it is preferred that the block for supporting the tool is fixed to the framework at a position separate from the design block and the positioning block.

The novel die taught in the present specification is suitable for use in casting. In particular, the die is suitable for a full-mold casting process using an evaporative pattern. In other words, in another aspect of the die taught in the present specification, the design block, the positioning block and the plurality of rods are formed integrally by casting in the full-mold casting process using the evaporative pattern. The advantage of the die taught in the present specification being suitable for the full-mold casting process using the evaporative pattern will be described in the embodiment.

DESCRIPTION OF EMBODIMENTS

Figure 1:
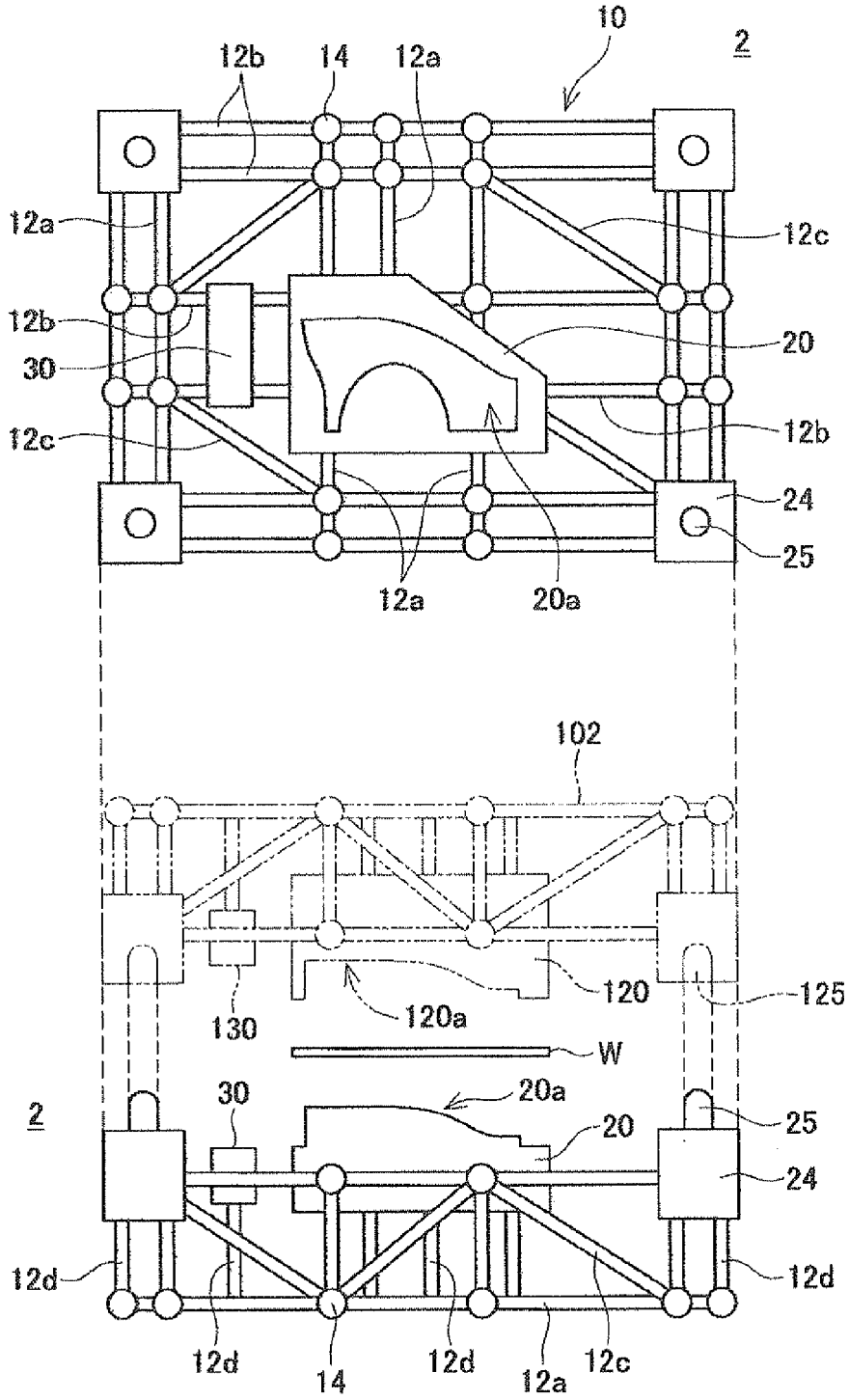
FIG. 1 shows a plan view of a die of the embodiment.
Figure 2:
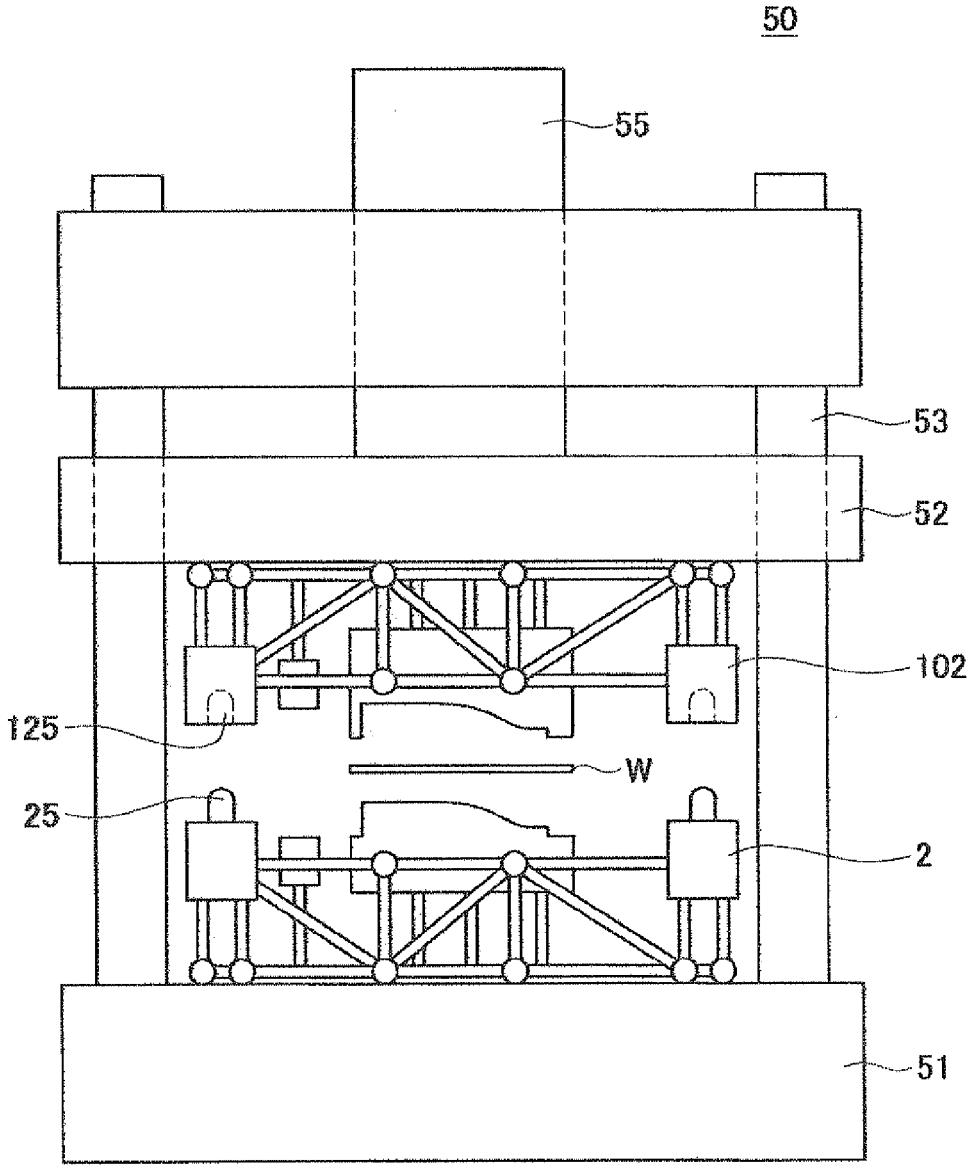
FIG. 2 shows a schematic side view of a press machine.

The figure at an upper side of FIG. 1 shows a plan view of a die 2 of the embodiment, and a figure at a lower side of FIG. 1 shows a side view of the die 2. The virtual line shows a contraposed die 102. Below, the contraposed die 102 is called a counterpart die 102. The dies 2 and 102 are dies for a machine press and, as shown in FIG. 2, are used by being attached to a press machine 50. The die 2 is fixed to a bolster 51, and the counterpart die 102 is fixed to a slider 52. The slider 52 is moved up and down by an actuator 55 while being guided by a support 53.

The die 2 has a design block 20, positioning blocks 24, and a support block 30. The design block 20 has a design surface 20*a* for transferring a target shape to a work plate. The die 2 of this embodiment is a die for press forming a fender of an automobile. The design surface 20*a* is formed in a shape of the fender, Moreover, the positioning blocks 24 are disposed at the four corners of the die 2. It should be noted that the reference number 24 has been appended to only one of the positioning blocks, and the reference number has been omitted on the other positioning blocks.

A work plate W deforms to a shape of the design surface 20*a* when the work plate W is sandwiched between the design block 20 of the die 2 and a design block 120 of the counterpart die 102, and the actuator 55 lowers the slider 52, applying load to the work plate W. That is, the shape of the design surface 20*a* is transferred to the work plate W.

When the die 2 and the counterpart die 102 are to be fitted together, guide pins 25 of the die 2 fit into guide bushes 125 of the counterpart die 102, allowing the die 2 and the counterpart die 102 to be positioned relative to one another. That is, the design surface 20*a* of the die 2 and a design surface 120*a* of the counterpart die 102 can be positioned relative to one another. The guide pin 25 is formed on the positioning block 24. As shown in FIG. 1, the positioning blocks 24 are located at the four corners of the die 2 so as to surround the design block 20. By locating the positioning blocks 24 at the four corners of the design block 20, the relative position of the design surface 20*a* of the die 2 and the design surface 120*a* of the counterpart die 102 can be determined accurately.

The support block 30 is a block to which a variety of tools utilizing a pressing load is attached. The support block 30 will be described later.

The design block 20, the positioning blocks 24 and the support block 30 are mutually connected by a plurality of rods 12. The rods are connected by joints 14. The plurality of rods 12 is assembled vertically, horizontally and obliquely to form a framework 10. The plurality of rods 12 constituting the framework 10 is classified into several types. That is, the plurality of rods 12 is classified into longitudinal rods 12*a*, transverse rods 12*b*, oblique rods 12*c*, and vertical rods 12*d*. When assembled, the longitudinal rods 12*a* and the transverse rods 12*b* form a lattice in a horizontal plane. The vertical rods 12*d* are disposed in a vertical plane. Several longitudinal rods 12*a*, transverse rods 12*b* and vertical rods 12*d* constitute a rectangular parallelepiped. The oblique rods 12*c* are disposed on diagonals of the lattice. The entire framework 10 also forms a rectangular parallelepiped. Moreover, it should be noted that the reference numbers have been omitted for part of the rods in the figure.

A portion where the latticed window is rectangular constitutes a Rahmen structure. A portion, including the oblique rods 12*c*, where the latticed window is triangular constitutes a truss structure (provided there is a pin connection between the rods). That is, the framework 10 has the framework structure described above. Moreover, the truss structure means a framework structure in which only axial force acts on the rods and moment does not act thereon, and the Rahmen structure means a framework structure in which both axial force and moment act on the rods. Both the Rahmen structure and the truss structure are configured only of rods, and consequently, while having a high strength, have adequate flexibility as a whole.

As shown in FIG. 1, seen from the plan view, the design block 20 is supported at four sides by the rods 12 (the longitudinal rods 12*a* and the transverse rods 12*b*). Further, the design block 20 is also supported from the backside by the vertical rods 12*d*. Due to being supported from the four sides and the backside by the rods 12, upon receiving the load, the design block 20 can move flexibly, although by a small amount. That is, when a biased pressing load has been applied, the design block 20 moves slightly so that the pressing load is distributed uniformly. This slight movement solves the bias of the pressing load. The position of the entirety of the die 2 relative to the counterpart die 102 is determined accurately by the positioning blocks 24. On the other hand, due to being supported from the four sides and the backside by the rods 12, the design block 20 moves slightly to solve the bias of the pressing load. Since the biased pressing load is not concentrated on the design surface 20*a*, wear of the die can be suppressed, and high work molding precision is maintained.

The rigidity of the design block 20 is greater than the rigidity of the framework 10 assembled from the rods 12. Further, the rigidity of the positioning blocks 24 is also greater than the rigidity of the framework 10. Consequently, when the pressing load is acted, the design block 20 and the positioning blocks 24 undergo less deformation than the framework 10. That is, the entire framework 10 deforms, whereas the deformation of the design block 20 and the positioning blocks 24 is suppressed. Since the deformation of the design block 20 itself is suppressed, high work molding precision can be maintained.

Figure 3:
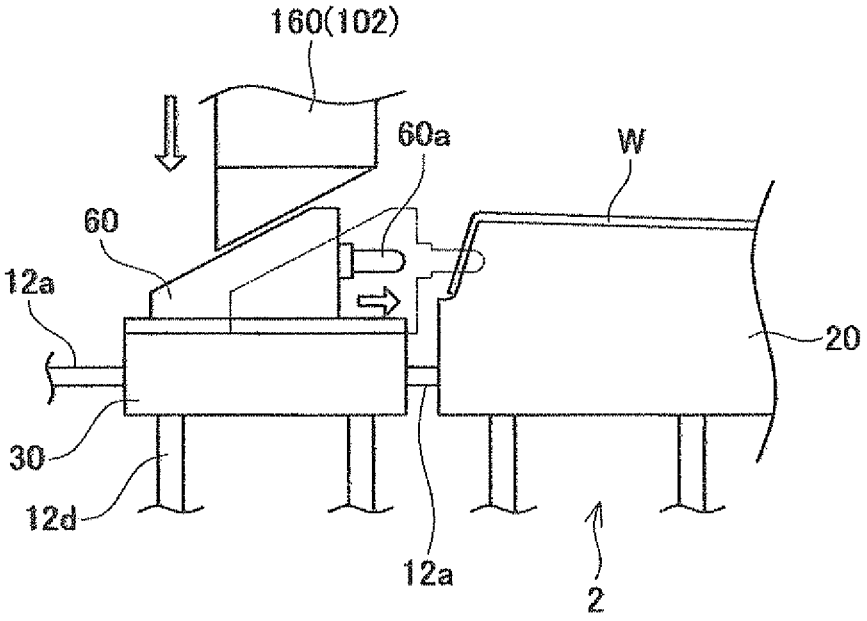
FIG. 3 shows an example of a tool utilizing a pressing load.

The support block 30, and the tools utilizing the pressing load will be described. FIG. 3 is a figure for describing a tool 60 for making a hole in a side surface of the work plate W. An upper surface of the support block 30 is flat, and the tool 60 is attached to this upper surface. A punch 60*a* is attached to a side of the tool 60. An upper surface of the tool 60 is inclined. A counterpart tool 160 is attached to the counterpart die 102 above the tool 60. A lower surface of the counterpart tool 160 is parallel to the inclined upper surface of the tool 60. When the counterpart tool 160 is lowered, the inclined upper surface of the tool 60 makes contact with the inclined lower surface of the counterpart tool 160. When the counterpart tool 160 is lowered further, the tool 60 is moved toward the right of FIG. 3 (in a horizontal direction) by the pressing load acted to the inclined upper surface. That is, the pressing load is converted to a direction perpendicular to the pressing direction. When the tool 60 moves, the punch 60*a* at a tip thereof makes a hole in the side surface of the work plate W. Thus, the tool 60 moves horizontally employing the pressing load of the press machine, making a hole in the side surface of the work plate W.

The pressing load is also acted to the tool 60. At this occasion, the support block 30 that supports the tool 60 is supported at the four sides and the backside by the rods 12*a*, 12*d* and, as with the design block 20, the support block 30 shifts slightly to reduce the bias of the pressing load.

Summarized, the advantages of the die 2 are as follows. In the die 2, the design block 20, the positioning blocks 24, and the support block 30 are connected by the plurality of rods. The position relative to the counterpart die 102 is adjusted accurately by the positioning blocks 24. On the other hand, the design block 20 and the support block 30 are supported from the backside and the four sides in a horizontal plane by the rods 12, and consequently move slightly to disperse a biased pressing load. Since concentration of the pressing load is mitigated, local wearing of the design surface does not occur and, further, high molding precision of the work can be achieved. Further, the framework 10 that is assembled from the plurality of rods has many latticed windows, and is consequently well ventilated. As a result, it also has the advantage that dust, etc. does not adhere readily.

The die 2 having the framework structure described above is suitable for being formed integrally by casting in a full-mold casting process using an evaporative die. The reason therefore is as follows. First, since the latticed windows surrounded by the rods are large, there is an advantage that it is easy to pack sand densely. Further, in the casting process, the cast product thermally contracts at the time of cooling and the dimensions change. However, the thermal contraction of rods is easy to predict, and consequently the dimensions of the framework are easily controlled. Further, the framework assembled from the plurality of rods cools in a relatively short time after casting. For example, a die for an automobile body is extremely large. When an extremely large die is cast, a long time is required for cooling. However, the framework assembled from the plurality of rods cools rapidly even if the die is extremely large, and consequently the manufacturing time can be reduced.

Next, points concerning the technique taught in the present specification will be given. The lattice surrounded by the rods is not restricted to being square or triangular. The lattice surrounded by the rods may be trapezoid or polygonal. That is, the framework may be assembled such that the rods are arranged irregularly. Further, the cross-sectional shape of the rods may be round, rectangular, or another polygonal shape. Further, a framework in which a plate such as a nameplate, dustproof plate, etc. is attached to the framework is also included in the scope of the technique taught in the present specification. The reason is that the nameplate or dustproof plate is not a member that contributes to the strength of the framework.

The die 2 of the embodiment has the positioning blocks 24 at the four corners. The number of positioning blocks of the die is not restricted to four. The technique taught in the present specification can also be applied, for example, to a die having two positioning blocks. For example, the die may have positioning blocks at only two corners on a diagonal line. The die may have more than four positioning blocks. Further, the position of the positioning blocks is not restricted to the corners of the die. The technique taught in the present specification can also be applied, for example, to a die having positioning blocks at each of a pair of opposing sides of a die. In a plan view of the die, the positioning blocks may be arranged at an inner side of a periphery of a framework. The technique taught in the present specification can also be applied to such a die.

A fastening member such as a pin, bolt, rivet, etc. may join the rods together, or may join the rods with the blocks. Instead, welding may join the rods together, or may join the rods with the blocks. As described earlier, the plurality of rods and the blocks may be formed integrally by casting.

Further, the connection between the rods may be either a pin junction or a rigid junction. Moreover, in case the rods are assembled such that the latticed window forms a triangle, and each of the rods forms a pin junction, the framework becomes a truss structure. In case the design block, the positioning blocks and the rods are all formed integrally by casting, the junction portion of the rods forms a rigid junction, and consequently the framework 10 has a Rahmen structure.

Upon the press processing, a cushion ring may be used in combination with the die 2. A cushion ring is a component for pressing the work plate, and is disposed so as to surround the design block.

Specific examples of the present invention are described above in detail, but these examples are merely illustrative and place no limitation on the scope of the patent claims. The technology described in the patent claims also encompasses various changes and modifications to the specific examples described above. The technical elements explained in the present specification or drawings provide technical utility either independently or through various combinations. The present invention is not limited to the combinations described at the time the claims are filed. Further, the purpose of the examples illustrated by the present specification or drawings is to satisfy multiple objectives simultaneously, and satisfying any one of those objectives gives technical utility to the present invention.

LIST OF REFERENCE SIGNS

2: Die, 10: Framework, 12: Rod, 12*a*: Longitudinal Rod, 12*b*: Transverse Rod, 12*c*: Oblique Rod, 12*d*: Vertical Rod,

20: Design Block, 20*a*: Design Surface, 24: Positioning Block, 25: Guide Pin, 30: Support Block, 50: Press Machine, 51: Bolster, 52: Slider, 53: Support, 55: Actuator, 60: Tool, 60*a*: Punch, 102: Counterpart Die

The invention claimed is:

1. A pair of dies for a machine press, the pair of dies being contraposed to each other and configured to press a work plate and to form the work plate into a target shape, each die of the pair of dies comprising:

a design block having a design surface configured to transfer a target shape to the work plate by sandwiching the work plate with a design block of the counterpart die; and a positioning block configured to directly engage with a positioning block of the counterpart die for positioning the die relative to the contraposed die;

wherein the design block and the positioning block are spaced apart from each other, the design block is supported only by a plurality of rods, the design block being connected to the positioning block by rods in the plurality of rods, and the plurality of rods have a flexibility such that the design block moves with respect to the positioning block.

2. The pair of dies of claim 1, wherein:

the plurality of rods constitute a framework configured by any one of a Rahmen structure, a truss structure, and a combination of the Rahmen structure and the truss structure; and the design block and the positioning block are fixed to the framework at positions separated from one another.

3. The pair of dies of claim 2 wherein:

the design block is surrounded by the plurality of rods in a plan view of the die; and the positioning block is disposed at a periphery of the die.

4. The pair of dies of claim 2 wherein each of four sides of the design block is supported by a rod in a plan view of the die.

5. The pair of dies of claim 2, wherein the framework includes a vertical rod that supports a backside of the die.

6. The pair of dies of claim 2 further comprising:

a tool support block, being configured to support a tool for machining the work plate utilizing a pressing load, and being fixed to the framework at a position separated from the design block and the positioning block.

7. The pair of dies of claim 1, wherein the design block, the positioning block and the plurality of rods are formed integrally by casting.

8. The pair of dies of claim 7, wherein the design block, the positioning block and the plurality of rods are formed integrally by a full-mold casting process.

* * * * *